US009903167B2

(12) United States Patent
Dewald et al.

(10) Patent No.: US 9,903,167 B2
(45) Date of Patent: Feb. 27, 2018

(54) INTERLOCK SYSTEM AND METHOD FOR DRILLING RIG

(71) Applicant: Tesco Corporation, Houston, TX (US)

(72) Inventors: Brian Dewald, Calgary (CA); Douglas Greening, Calgary (CA)

(73) Assignee: Tesco Corporation, Houston, TX (US)

( * ) Notice: Subject to any disclaimer, the term of this patent is extended or adjusted under 35 U.S.C. 154(b) by 937 days.

(21) Appl. No.: 14/268,730

(22) Filed: May 2, 2014

(65) Prior Publication Data

US 2015/0315855 A1 Nov. 5, 2015

(51) Int. Cl.

| | |
|---|---|
| ***E21B 19/06*** | (2006.01) |
| ***E21B 19/07*** | (2006.01) |
| ***E21B 44/00*** | (2006.01) |
| ***E21B 19/10*** | (2006.01) |
| ***E21B 33/04*** | (2006.01) |

(52) U.S. Cl.

CPC ..... *E21B 19/06* (2013.01); *E21B 19/07* (2013.01); *E21B 19/10* (2013.01); *E21B 33/0422* (2013.01); *E21B 44/00* (2013.01)

(58) Field of Classification Search

CPC ..... E21B 19/00; E21B 19/06; E21B 44/00; E21B 19/10; E21B 19/07; E21B 33/0422

See application file for complete search history.

(56) References Cited

U.S. PATENT DOCUMENTS

| | | | | |
|---|---|---|---|---|
| 5,791,410 | A * | 8/1998 | Castille | E21B 19/10 166/77.1 |
| 7,086,461 | B2 * | 8/2006 | Schulze-Beckinghausen | E21B 19/07 166/77.53 |
| 7,281,587 | B2 * | 10/2007 | Haugen | E21B 19/00 166/380 |
| 8,074,711 | B2 * | 12/2011 | Ellis | E21B 19/07 166/77.51 |
| 8,136,603 | B2 | 3/2012 | Schneider | |
| 8,356,675 | B2 * | 1/2013 | Pietras | E21B 19/16 166/380 |
| 8,439,121 | B2 | 5/2013 | Nikiforuk et al. | |
| 9,206,657 | B2 * | 12/2015 | Kuttel | E21B 41/0021 |
| 2007/0131416 | A1 * | 6/2007 | Odell, II | E21B 19/06 166/250.1 |
| 2008/0264648 | A1 | 10/2008 | Bernd-Georg et al. | |
| 2009/0151934 | A1 * | 6/2009 | Heidecke | E21B 3/02 166/250.01 |
| 2009/0272542 | A1 * | 11/2009 | Begnaud | E21B 19/07 166/380 |

(Continued)

FOREIGN PATENT DOCUMENTS

| | | |
|---|---|---|
| CA | 2773174 | 9/2013 |
| WO | 02/092959 | 11/2002 |

OTHER PUBLICATIONS

International Search Report and Written Opinion for PCT/US2015/027810 dated Jul. 10, 2015.

*Primary Examiner* — Michael R Wills, III

(74) *Attorney, Agent, or Firm* — Fletcher Yoder, P.C.

(57) ABSTRACT

Present embodiments are directed to a system and method for coordinating operation of a gripping device of a top drive system and power slips of a drilling rig to ensure that at least one of the gripping device and the power slips is engaged with a length of tubular and/or a drill string to support weight of the length of tubular and weight of the drill string.

20 Claims, 5 Drawing Sheets

(56) References Cited

U.S. PATENT DOCUMENTS

| | | | | |
|---|---|---|---|---|
| 2011/0048737 | A1 | 3/2011 | Schneider | |
| 2012/0043071 | A1 | 2/2012 | Matherne, Jr. et al. | |
| 2012/0055682 | A1* | 3/2012 | Bouligny | E21B 19/07 166/380 |
| 2012/0152530 | A1* | 6/2012 | Wiedecke | E21B 19/07 166/250.01 |
| 2013/0118760 | A1 | 5/2013 | Kuttel et al. | |

* cited by examiner

INTERLOCK SYSTEM AND METHOD FOR DRILLING RIG

BACKGROUND

Embodiments of the present disclosure relate generally to the field of drilling and processing of wells. More particularly, present embodiments relate to a system and method for stabilizing a top drive during a drilling process, a casing process, or another type of well processing operation.

Top drives are typically utilized in well drilling and maintenance operations, such as operations related to oil and gas exploration. In conventional oil and gas operations, a well is typically drilled to a desired depth with a drill string, which includes drill pipe and a drilling bottom hole assembly (BHA). During a drilling process, the drill string may be supported and hoisted about a drilling rig by a hoisting system for eventual positioning down hole in a well. As the drill string is lowered into the well, a top drive system may rotate the drill string to facilitate drilling.

BRIEF DESCRIPTION

In accordance with one aspect of the disclosure, a system includes a top drive system including a gripping device configured to support a length of tubular, power slips configured to support a drill string, and an interlock system configured to coordinate operation of the top drive system and the power slips to ensure that at least one of the top drive system and the power slips is supporting weight of the length of tubular and weight of the drill string.

Another embodiment includes a system having a controller configured to coordinate operation of a gripping device of a top drive system and power slips of a drilling rig to ensure that at least one of the gripping device and the power slips is engaged with a length of tubular and/or a drill string to support weight of the length of tubular and weight of the drill string.

In accordance with another aspect of the disclosure, a method includes measuring a first weight of a length of tubular and/or a drill string supported by a gripping device of a tubular drive system of a drilling rig, measuring a second weight of the length of tubular and/or the drill string supported by power slips of the drilling rig, and coordinating operation of the gripping device and the power slips based on the first and second weights to ensure that at least one of the gripping device and the power slips is supporting the first and second weights.

DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

Present embodiments provide an interlock system configured to regulate and coordinate operation of one or more components of a drilling rig during a casing running or tripping operation to ensure that lengths of tubular and/or a drill string are continually supported by a component of the drilling rig. For example, the interlock system may be configured to regulate operation of a gripping device of a top drive system or other tubular drive system, power slips positioned near a rig floor of the drilling rig, or other component of the drilling rig configured to support the weight of tubular or a drill string. Furthermore, the interlock system may be configured to regulate and coordinate operation of the one or more components of the drilling rig based on measured feedback associated with a casing running or tripping operation. For example, the interlock system may include one or more sensors and/or monitoring systems configured to measure forces (e.g., weight) acting on the one or more components of the drilling rig, such as a weight of a length of tubular or a drill string acting on the gripping device or the power slips. Based on the measured feedback, the interlock system may coordinate operation of the gripping device and the power slips to ensure that at least one of the gripping device and the power slips is supporting the weight of the tubular and the drill string.

Figure 1:
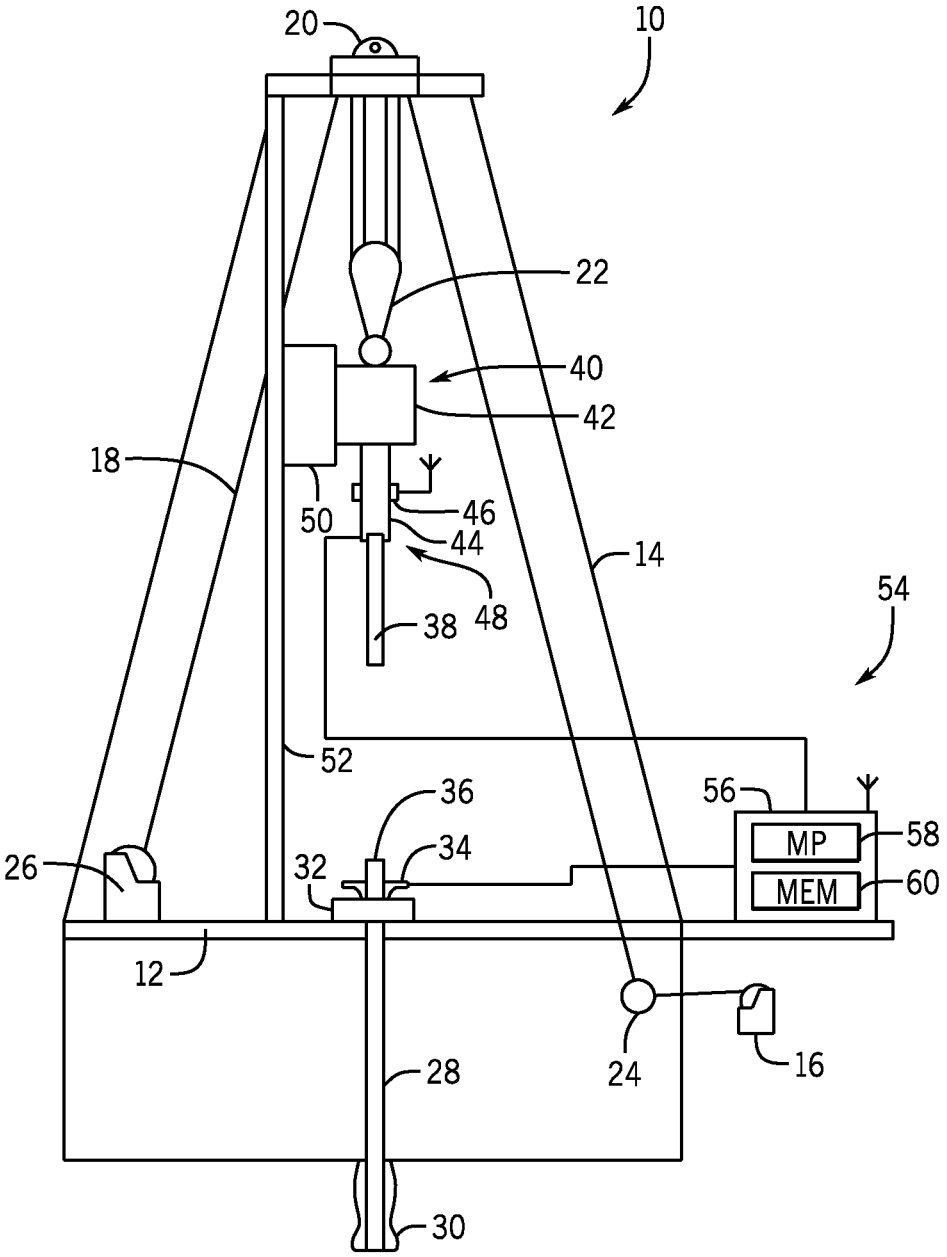
FIG. 1 is a schematic of an embodiment of a well being drilled with an interlock system, in accordance with present techniques.

Turning now to the drawings, FIG. 1 is a schematic of a drilling rig 10 in the process of drilling a well in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a drill string 28 extends downward into a wellbore 30 and is held stationary with respect to the rig floor 12 by a rotary table 32 and slips 34 (e.g., power slips). A portion of the drill string 28 extends above the rig floor 12, forming a stump 36 to which another length of tubular 38 (e.g., a joint of drill pipe) may be added.

A tubular drive system 40, hoisted by the traveling block 22, positions the tubular 38 above the wellbore 30. In the illustrated embodiment, the tubular drive system 40 includes a top drive 42, a gripping device 44, and a tubular drive monitoring system 46 (e.g., an operating parameter monitoring system) configured to measure forces acting on the tubular drive system 40, such as torque, weight, and so forth. For example, the tubular drive monitoring system 46 may measure forces acting on the tubular drive system 40 via sensors, such as strain gauges, gyroscopes, pressure sensors, accelerometers, magnetic sensors, optical sensors, or other sensors, which may be communicatively linked or physically integrated with the system 46. The gripping device 44 of the tubular drive system 40 is engaged with a distal end 48 (box end) of the tubular 38. The tubular drive system 40, once coupled with the tubular 38, may then lower the coupled tubular 38 toward the stump 36 and rotate the tubular 38 such that it connects with the stump 36 and becomes part of the drill string 28. FIG. 1 further illustrates the tubular drive system 40 coupled to a torque bushing system 50. More specifically, the torque bushing system 50 couples the tubular drive system 40 to a torque track 52. The torque bushing system 50 and the torque track 52 function to counterbalance (e.g., counter react) moments (e.g., overturning and/or rotating moments) acting on the tubular drive system 40 and further stabilize the tubular drive system 40 during a casing running operation or other operation.

The drilling rig 10 further includes an interlock system 54, which is configured to control the various systems and components of the drilling rig 10 that grip, lift, release, and support the tubular 38 and the drill string 28 during a casing running or tripping operation. For example, the interlock system 54 may control operation of the gripping device 44 and the power slips 34 based on measured feedback (e.g., from the tubular drive monitoring system 46 and other sensors) to ensure that the tubular and the drill string 28 are adequately gripped and supported by the gripping device 44 and/or the power slips 34 during a casing running operation. In this manner, the interlock system 54 may reduce and/or eliminate incidents where lengths of tubular 38 and/or the drill string 28 are unsupported.

In the illustrated embodiment, the interlock system 54 includes a controller 56 having one or more microprocessors 58 and a memory 60. For example, the controller 56 may be an automation controller, which may include a programmable logic controller (PLC). The memory 60 is a non-transitory (not merely a signal), computer-readable media, which may include executable instructions that may be executed by the microprocessor 56. The controller 56 receives feedback from the tubular drive monitoring system 46 and/or other sensors that detect measured feedback associated with operation of the drilling rig 10. For example, the controller 56 may receive feedback from the tubular drive system 46 and/or other sensors via wired or wireless transmission. Based on the measured feedback, the controller 56 regulates operation of the gripping device 44 and the power slips 34. In particular, the operation of the gripping device 44 and the power slips 34 may be coordinated by the controller 56 to ensure that at least one of the gripping device 44 and/or the power slips 34 is adequately gripping and supporting the weight of the tubular 38 and/or the drill string 28 (e.g., during a casing running operation). In certain embodiments, the controller 56 may also be configured to regulate operation of other components of the drilling rig 10, such as the top drive 42. The coordinated operation of the gripping device 44 and the power slips 34 is discussed in further detail below.

It should be noted that the illustration of FIG. 1 is intentionally simplified to focus on the interlock system 54 of the drilling rig 10, which is described in greater detail below. Many other components and tools may be employed during the various periods of formation and preparation of the well. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs. Similarly, while shown as a surface (land-based) operation, the well may be formed in water of various depths, in which case the topside equipment may include an anchored or floating platform.

Figure 2:
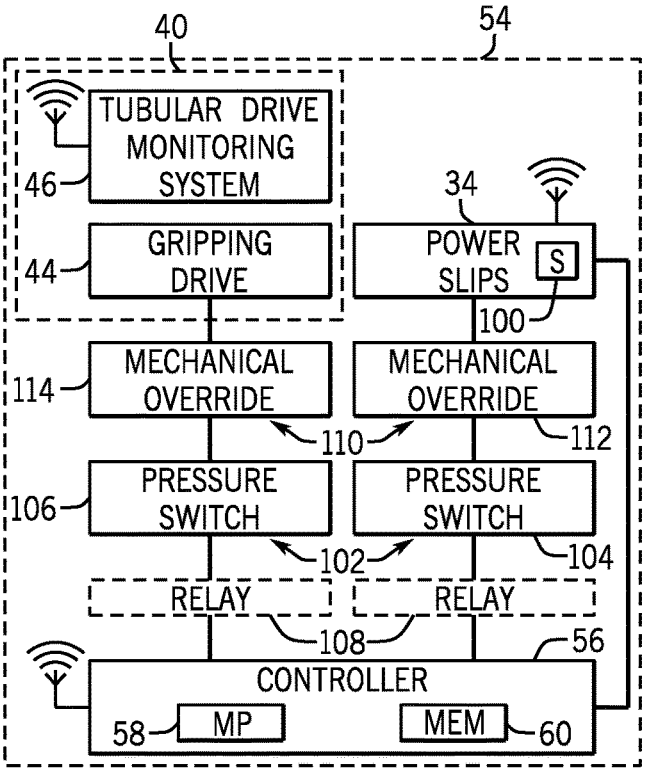
FIG. 2 is a schematic of an embodiment of the interlock system, in accordance with present techniques.

FIG. 2 is a schematic representation of the interlock system 54 for the drilling rig 10. As mentioned above, the interlock system 54 include the controller 56, which is configured to regulate and coordinate operation of the gripping device 44 and the power slips 34 (e.g., based on measured operating parameter feedback) to ensure that the tubular 38 and the drill string 28 are supported by the gripping device 44, the power slips 34, or both. The controller 56 may receive measured feedback via wired or wireless transmission from the tubular drive monitoring system 46, sensors 100 of the power slips 34, or other components of the drilling rig 10. The measured feedback provided by the tubular drive monitoring system 46 and the sensors 100 of the power slips 34 is described in further detail below. Furthermore, it will be appreciated that each of the types of measured feedback described below may be used in any combination with one another to coordinate operation of the gripping device 44 and the power slips 34. Additionally, other types of feedback may also be used in coordinating operation of the gripping device 44 and the power slips 34.

In the illustrated embodiment, the controller 56 is configured to control operation of the power slips 34 and the gripping device 44 by applying control signals to pressure switches 102 of the interlock system 54. In particular, the interlock system 54 includes a first pressure switch 104 for actuating the power slips 34 and a second pressure switch 106 for actuating the gripping device 44. In certain embodiments, the interlock system 54 may also include relays 108 for amplifying the control signals of the controller 56 before the control signals are sent to the pressure switches 102. The pressure switches 102 may also enable the controller 56 to detect a gripping force of the gripping device 44 and/or the power slips 34 on the tubular 38 and/or the drill string 28. In certain embodiments, the first pressure switch 104 may detect a gripping force of the power slips 34 on the drill string 28 and the second pressure switch 106 may detect a gripping force of the gripping device 44 on the length of tubular 38. Additionally, in certain embodiments, the controller 56 may receive feedback from the first pressure switch 104 indicative of the gripping force of the power slips 34 on the drill string and from the second power switch 106 indicative of the gripping force of the gripping device 44 on the length of tubular 38. As a result, the controller 56 may be configured to detect that the gripping device 44 and/or the power slips 34 are gripping the tubular 38 and/or drill string 28 with sufficient force to ensure that the tubular 38 and/or the drill string 28 do not slip or drop. Additionally, the pressure switches 102 may be configured to block disengagement (e.g., "lockout") the gripping device 44 and/or the power slips 34 until sufficient pressure is applied to the other of the gripping device 44 and/or the power slips 34 to support the tubular 38 and/or the drill string 28. For example, the second pressure switch 106 may be configured to block disengagement of the power slips 34 until sufficient pressure is applied to the gripping device 44 for gripping and supporting the tubular 38 and/or the drill string 28. Similarly, the first pressure switch 104 may be configured to block disengagement of the gripping device 44 until sufficient pressure is applied to the power slips 34 for gripping and supporting the tubular 38 and/or the drill string 28.

The interlock system 54 may also use other measured feedback to coordinate operation of the gripping device 44 and the power slips 34. For example, the tubular drive monitoring system 46 may be configured to detect a gripping distance (e.g., a radial gripping or closing distance) that the gripping device 44 has traveled (e.g., radially inward) to grip the tubular 38. In certain embodiments, the gripping distance traveled by the gripping device 44 may be measured using sensors, such as magnetic sensors, Hall-effect sensors, optical sensors, or other suitable types of sensors, which may be coupled to the gripping device 44. The sensors 100 of the power slips 34 may similarly calculate a gripping distance (e.g., radially gripping or closing distance) that the power slips 34 have traveled to grip the drill string 28. As will be appreciated, the measured gripping distance traveled by the gripping device 44 and/or power slips 34 may be used to further calculate a gripping force of the power slips 34 and/or gripping device 44. Additionally, the measured gripping distances may be used to verify that the gripping device 44 and/or power slips 34 have properly gripped the tubular 38 and/or drill string 28 instead of another component, such as a collar.

The interlock system 54 further includes mechanical overrides 110, which may be used to enable releasing or disengagement of the power slips 34 and/or gripping device 44 at a desired time. In other words, the mechanical overrides 110 interrupt control of the power slips 34 and/or gripping device 44 by the controller 56 to enable immediate or instant disengagement of the power slips 34 and/or gripping device 44. For example, a first mechanical override 112 may be actuated to enable disengagement of the power slips 34, and a second mechanical override 114 may be actuated to enable disengagement of the gripping device 44. In certain embodiments, the interlock system 54 may include one mechanical override 110 to enable disengagement of both the power slips 34 and the gripping device 44 at the same time. In one embodiment, the mechanical overrides 110 may be operated with a key that is turned by a user or operator to actuate the mechanical override 110 and disengage the power slips 34 or the gripping device 44.

As will be appreciated, the interlock system 54 shown in FIG. 2 is simplified to focus on the coordinated control of the components of the drilling rig 10 during a casing running or tripping operation. As such, it will be appreciated that the interlock system 54 may include other components to facilitate operation of the drilling rig 10 components, such as the gripping device 44 and the power slips 34. For example, the interlock system 54 may include additional valves, electronics, switches, sensors, or other components to enable operation of the gripping device and the power slips 34.

FIGS. 3-9 are schematic representations of an embodiment of the drilling rig 10 and interlock system 54, illustrating operation of the interlock system 54 during a casing running operation. However, it will be appreciated that the interlock system 54 may also be similarly used during a casing tripping operation.

Figure 3:
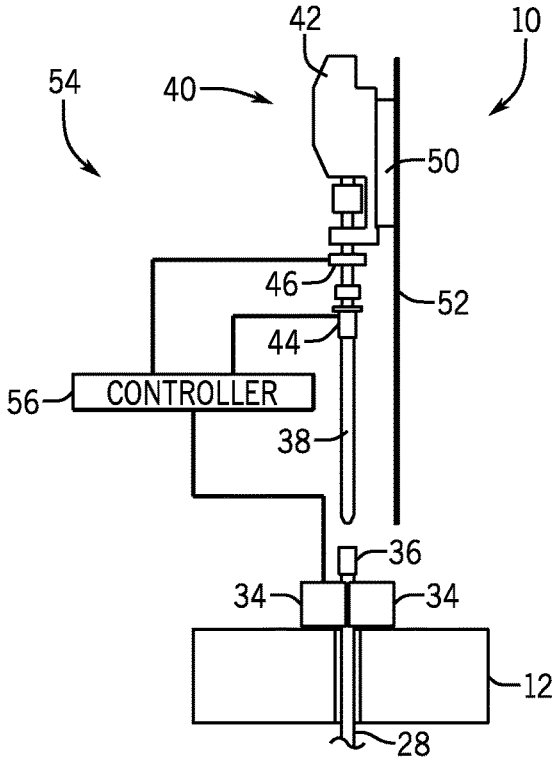
FIG. 3 is a schematic of an embodiment of a well, illustrating operation of the interlock system, in accordance with present techniques.

In FIG. 3, the tubular drive system 40 has just picked up the tubular 38 for connection to the drill string 28. As such, the gripping device 44 is in a locked and engaged position. In particular, the controller 56 is controlling the gripping device 44 to ensure that the gripping device 44 is adequately gripping the tubular 38 to support the weight of the tubular 38. Similarly, the power slips 34 are in a locked and engaged position, and the controller 56 is controlling the power slips 34 to ensure that the power slips 34 are adequately gripping the drill string 28 to support the weight of the drill string 28. For example, the controller 56 may include an algorithm (e.g., stored in the memory 60) configured to calculate a desired gripping force as a function of a weight supported by the gripping device 44 and/or power slips 34, a distance (e.g., radial gripping or closing distance) that the gripping device 44 and/or power slips have moved to grip the tubular 38 or drill string 28, or other measured parameter.

Figure 4:
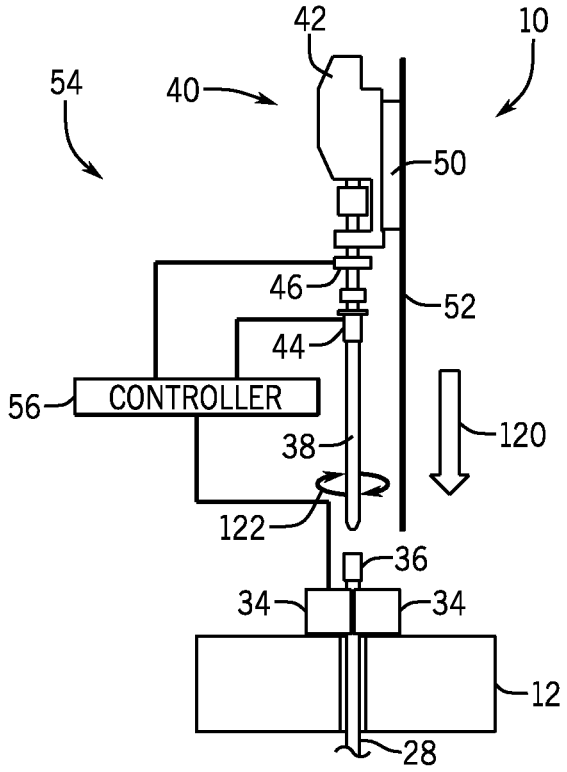
FIG. 4 is a schematic of an embodiment of a well, illustrating operation of the interlock system, in accordance with present techniques.

As shown in FIG. 4 and indicated by arrow 120, the tubular drive system 40 lowers the tubular 38 toward the stump 38 of the drill string 28 for connection of the tubular 38 to the drill string 28. Additionally, as indicated by arrow 122, the top drive 42 rotates the tubular 38 as the tubular 38 is lowered to the stump 36 of the drill string 28 by the tubular drive system 40. In the embodiment shown in FIG. 4, the controller 56 continues to operate the gripping device 44 and the power slips 34 such that the gripping device 44 and the power slips 34 are both in the locked and engaged position. In this manner, the tubular 38 and the drill string 28 both remain gripped and supported. Furthermore, while the tubular 38 is connected to the drill pipe 38, the controller 56 continues to regulate the gripping device 44 and power slips 34 such that both are in the engaged and locked position.

Figure 5:
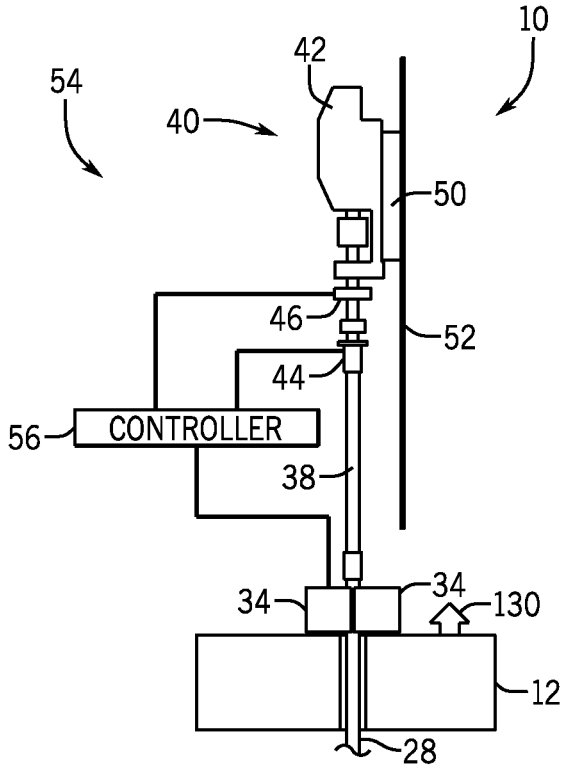
FIG. 5 is a schematic of an embodiment of a well, illustrating operation of the interlock system, in accordance with present techniques.
Figure 6:
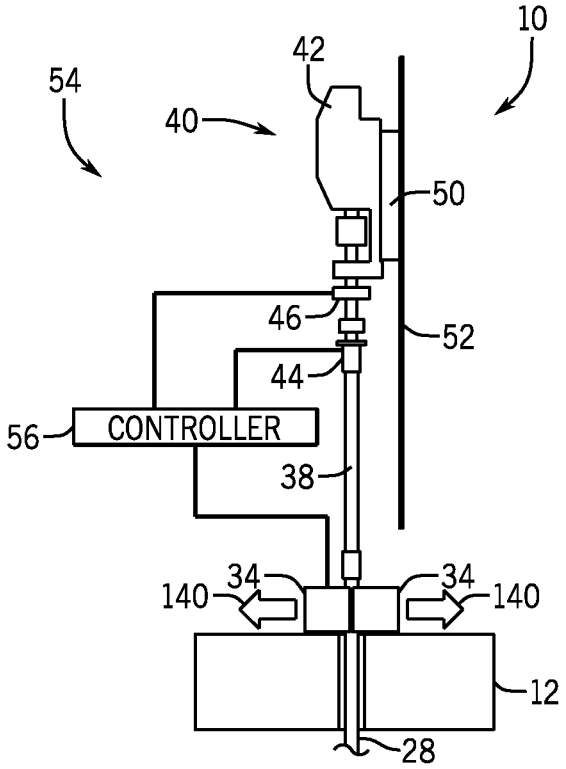
FIG. 6 is a schematic of an embodiment of a well, illustrating operation of the interlock system, in accordance with present techniques.

FIG. 5 illustrates an embodiment of the drilling rig 10 and interlock system 54 once the tubular 38 is connected to the stump 36 of the drill string 28. In other words, in FIG. 5, the tubular 38 is a part of the drill string 28. Once the tubular 38 is connected to the drill string 28, the top drive 42 may lift the entire drill string 28 upwards, as indicated by arrow 130. While the top drive 42 is lifting the drill string 28, the tubular drive monitoring system 46 may measure a weight or downward force acting on the top drive 42 and/or the gripping device 44. For example, the tubular drive monitoring system 46 may include strain gauges, accelerometers, or other sensors configured to measure a force acting on the top drive 42 and/or the gripping device 44 (e.g., a weight of the combined tubular 38 and drill string 28). Once the tubular drive monitoring system 46 detects that the top drive 42 and/or the gripping device 44 are supporting the weight of the drill string 28, the controller 56 may then send control signals to the power slips 34 to disengage and unlock the power slips, as indicated by arrows 140 of FIG. 6. For example, the controller 56 may be configured to send control signals to the power slips 34 to disengage and unlock the power slips 34 once the tubular drive monitoring system 46 has detected a threshold force (e.g., a preset number of pounds) acting on the top drive 42 and/or the gripping device 44.

Figure 7:
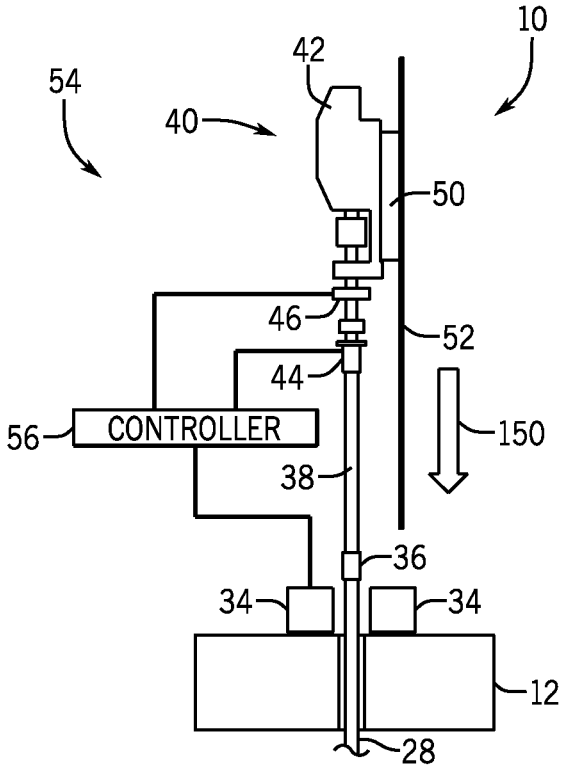
FIG. 7 is a schematic of an embodiment of a well, illustrating operation of the interlock system, in accordance with present techniques.
Figure 8:
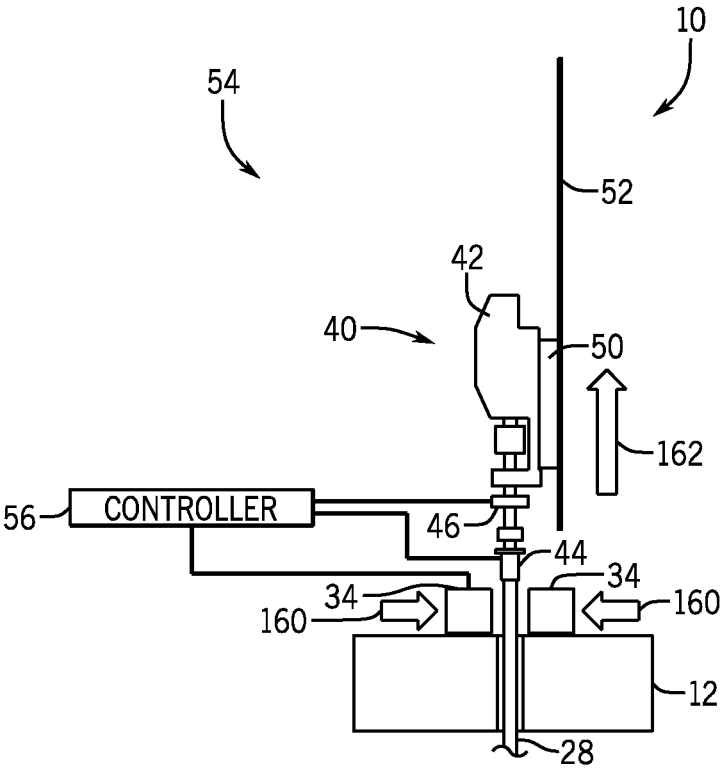
FIG. 8 is a schematic of an embodiment of a well, illustrating operation of the interlock system, in accordance with present techniques.
Figure 9:
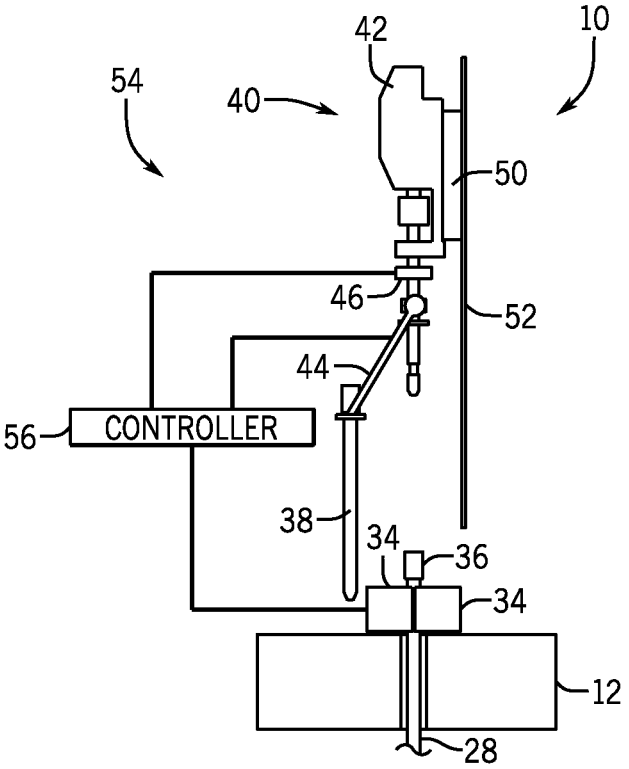
FIG. 9 is a schematic of an embodiment of a well, illustrating operation of the interlock system, in accordance with present techniques.

After the power slips 34 are unlocked and disengaged, the tubular drive system 40, which is supporting the entire weight of the drill string 28 via the engagement of the gripping device 44 with the tubular 38/drill string 28, will lower the drill string 28 further into the wellbore 30, as indicated by arrow 150 of FIG. 7. Once the drill string 28 is positioned at the proper height (e.g., relative to the power slips 34 and/or rig floor 12), the controller 56 may send control signals to the power slips 34 to lock, grip, and engage with the drill string 28, as indicated by arrows 160 of FIG. 8. After the power slips 34 grip the drill string 28, the weight of the drill string 28 supported by the gripping device 44 may be reduced. Once the tubular drive monitoring system 46 detects that the tubular drive system 40 (e.g., the gripping device 44) is supporting zero or negative weight (e.g., zero weight of the drill string 28 and/or an upward force acting on the tubular drive system 40 instead of a downward force), the controller 56 may send control signals to disengage and unlock the gripping system 44. In other words, the controller 56 may not send control signals to the gripping system 44 to unlock and disengage until the tubular drive monitoring system 46 detects that the gripping device 44 and/or top drive 42 are not supporting any weight or are not supporting weight above a certain threshold (e.g., a preset number of pounds). Thereafter, the tubular drive system 40 may travel up the torque track 52, as indicated by arrow 162, and prepare to lift another section of tubular 38 for coupling to the drill string 28. When the tubular drive system 40 is raised, the controller 56 may send control signals to the gripping device 44 to engage and grip another tubular 38, as shown in FIG. 9, and the process described above may be repeated to add another length of tubular 38 to the drill string 28.

The interlock system 54 and the drilling rig 10 described above may further include various modifications. For example, in certain embodiments, the gripping device 44 and/or the power slips 34 may have a default "closed" or "engaged" position (e.g., a gripping position), and the controller 56 may be configured to apply signals to "open" or "disengage" the gripping device 44 or the power slips 34 to release the tubular 38 or the drill string 28. In such an embodiment, the manual overrides 110 may be configured to release or open the gripping device 44 or the power slips 34.

Furthermore, in certain embodiments, the controller 56 may be programmed or configured for hysteresis control. For example, in circumstances where a measured weight supported by the gripping device 44 and/or the power slips 34 exceeds a predetermined threshold, the gripping device 44 and/or the power slips 34 may be actuated in a closed or "locked" position (e.g., automatically or by the controller 56). Additionally, the controller 56 may be configured to disable or disallow disengagement of the gripping device 44 and/or power slips 34 until the measured weight supported by the gripping device 44 and/or the power slips 34 falls below the predetermined threshold by a predetermined amount. In certain embodiments, the controller 56 may be further configured to disable or disallow disengagement of the gripping device 44 and/or power slips 34 until the measured weight supported by the gripping device 44 and/or the power slips 34 falls below the predetermined threshold by the predetermined amount for a set amount of time.

As discussed in detail above, present embodiments provide the interlock system 54, which is configured to regulate and coordinate operation of one or more components of the drilling rig 10 during a casing running or tripping operation to ensure that lengths of tubular 38 and/or the drill string 28 of the drilling rig 10 are continually supported by the gripping device 44 and/or the power slips 34 of the drilling rig 10. In particular, the interlock system 54 is configured to regulate and coordinate operation of the gripping device 44 and the power slips 34 based on measured feedback associated with a casing running or tripping operation. For example, the interlock system 54 may utilize feedback from the tubular drive monitoring system 46 and/or sensors 100 of the power slips 34, which are configured to measure forces (e.g., weight) acting on the gripping device 44 and the power slips 44 due to the tubular 38 and/or the drill string 28. Based on the measured feedback, the interlock system 54 may coordinate operation of the gripping device 44 and the power slips 34 to ensure that at least one of the gripping device 44 and the power slips 34 is supporting the weight of the tubular 38 and/or the drill string 28.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

The invention claimed is:

1. A system, comprising:

a top drive system comprising a gripping device configured to support a length of tubular;

power slips configured to support a drill string; and an interlock system configured to coordinate operation of the top drive system and the power slips to ensure that at least one of the top drive system and the power slips is supporting weight of the length of tubular and weight of the drill string, wherein the interlock system comprises a first pressure switch configured to actuate the power slips and a second pressure switch configured to actuate the gripping device, wherein the first pressure switch is configured to block disengagement of the power slips until sufficient pressure is applied to the gripping device to support the length of tubular and/or the drill string, and the second pressure switch is configured to block disengagement of the gripping device until sufficient pressure is applied to the power slips to support the length of tubular and/or the drill string, wherein the interlock system comprises a tubular drive monitoring system configured to measure a first radial gripping distance traveled by the gripping device to grip the length of tubular and a power slips sensor configured to measure a second radial gripping distance traveled by the power slips to grip the drill string.

2. The system of claim 1, wherein the interlock system comprises a controller configured to regulate operation of the gripping device and the power slips to ensure that at least one of the gripping device and the power slips is supporting weight of the length of tubular and weight of the drill string, and the controller is configured to regulate operation of the top drive system and the power slips based on measured feedback.

3. The system of claim 2, wherein the interlock system comprises a top drive monitoring system configured to measure a weight supported by the gripping device, and the measured feedback comprises the weight.

4. The system of claim 2, wherein the power slips comprise at least one sensor configured to measure a weight supported by the power slips, and the measured feedback comprises the weight.

5. The system of claim 2, wherein the controller is configured to apply control signals to the first and second pressure switches.

6. The system of claim 1, wherein the first pressure switch is configured to detect a first gripping force of the power slips on the drill string, and the second pressure switch is configured to detect a second gripping force of the gripping device on the length of tubular.

7. The system of claim 2, wherein the interlock system comprises at least one mechanical override switch configured to interrupt control of the gripping device and/or the power slips by the controller.

8. The system of claim 7, wherein the at least one mechanical override switch is configured to enable manual disengagement of the gripping device or the power slips.

9. A system, comprising:

a controller configured to coordinate operation of a gripping device of a top drive system and power slips of a drilling rig to ensure that at least one of the gripping device and the power slips is engaged with a length of tubular and/or a drill string to support weight of the length of tubular and/or weight of the drill string;

a first pressure switch configured to actuate the power slips and a second pressure switch configured to actuate the gripping device, wherein the first pressure switch is configured to block disengagement of the power slips until sufficient pressure is applied to the gripping device to support the length of tubular and/or the drill string, and the second pressure switch is configured to block disengagement of the gripping device until sufficient pressure is applied to the power slips to support the length of tubular and/or the drill string;

a tubular drive monitoring system configured to measure a first radial gripping distance traveled by the gripping device to grip the length of tubular; and a sensor configured to measure a second radial gripping distance traveled by the power slips to grip the drill string.

10. The system of claim 9, wherein the controller is configured to regulate operation of the top drive system and the power slips based on measured feedback associated with a casing running or tripping operation.

11. The system of claim 10, wherein the measured feedback comprises the weight of the length of tubular acting on the gripping device, the weight of the length of tubular acting on the power slips, the weight of the drill string acting on the gripping device, the weight of the drill string acting on the power slips, or any combination thereof.

12. The system of claim 9, comprising at least one manual override switch configured to interrupt control of the controller and enable manual disengagement of the gripping device of the top drive system, the power slips, or both.

13. The system of claim 9, wherein the controller is configured to apply control signals to the first and second pressure switches.

14. The system of claim 9, wherein the controller is configured to receive feedback from the first pressure switch indicative of a first gripping force of the power slips on the drill string and from the second pressure switch indicative of a second gripping force of the gripping device on the length of tubular.

15. The system of claim 9, wherein the tubular drive monitoring system is coupled to the top drive system, wherein the tubular drive monitoring system is configured to detect a weight of the length of tubular and/or the drill string supported by the top drive system, and wherein the tubular drive monitoring system is configured to wirelessly transmit the weight to the controller.

16. A method, comprising:

measuring a first weight of a length of tubular and/or a drill string supported by a gripping device of a tubular drive system of a drilling rig;

measuring a second weight of the length of tubular and/or the drill string supported by power slips of the drilling rig;

coordinating operation of the gripping device and the power slips based on the first and second weights to ensure that at least one of the gripping device and the power slips is supporting the first and second weights;

measuring a first radial gripping distance traveled by the power slips to grip the drill string;

measuring a second radial gripping distance traveled by the gripping device to grip the length of tubular;

calculating a first gripping force of the power slips on the drill string based on the first radial gripping distance; and calculating a second gripping force of the gripping device on the length of tubular based on the second radial gripping distance.

17. The method of claim 16, comprising wirelessly transmitting the first weight from a tubular drive monitoring system configured to detect the first weight to a controller configured to coordinate operation of the gripping device and the power slips.

18. The method of claim 16, comprising manually overriding the gripping device or the power slips to disengage the gripping device or the power slips.

19. The method of claim 16, comprising measuring the first gripping force of the power slips on the drill string with a first pressure switch, and measuring the second gripping force of the gripping device on the length of tubular with a second pressure switch.

20. The method of claim 16, comprising coordinating operation of the gripping device and the power slips based on the first and second gripping forces to ensure that at least one of the gripping device and the power slips is supporting the first and second weights.

* * * * *